US009515395B1

(12) United States Patent
Chadbourne

(10) Patent No.: US 9,515,395 B1
(45) Date of Patent: Dec. 6, 2016

(54) CLAMP HAVING A SADDLE WITH A PROJECTION RECEIVED IN A HOLE IN A TERMINAL SANDWICHED BETWEEN THE SADDLE AND A CONDUCTIVE POST

(71) Applicant: Hubbell Incorporated, Shelton, CT (US)

(72) Inventor: Christopher Gilpin Chadbourne, Merrimack, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/040,411

(22) Filed: Feb. 10, 2016

(51) Int. Cl.
*H01R 4/28* (2006.01)
*H01R 4/46* (2006.01)
*H01R 4/64* (2006.01)

(52) U.S. Cl.
CPC ..... *H01R 4/46* (2013.01); *H01R 4/643* (2013.01)

(58) Field of Classification Search
CPC ..... H01R 4/26; H01R 4/28; H01R 4/30; H01R 4/305; H01R 4/32; H01R 4/38; H01R 4/46; H01R 4/60; H01R 4/643
USPC ..... 439/771, 785, 793, 799, 800, 803, 804
See application file for complete search history.

(56) References Cited

U.S. PATENT DOCUMENTS 3,588,790 A * 6/1971 Shannon ..... H01R 4/00 439/764
3,699,506 A * 10/1972 Hollins ..... H01R 11/281 439/759
3,787,795 A * 1/1974 Thompson ..... H01R 4/643 174/78
5,087,214 A * 2/1992 Dewar ..... H01R 11/282 29/862
5,221,219 A * 6/1993 Thomson ..... H01R 11/281 29/857
5,302,143 A * 4/1994 Inoue ..... H01R 11/283 439/762

* cited by examiner

*Primary Examiner* — Chandrika Prasad
(74) *Attorney, Agent, or Firm* — Kaplan Breyer Schwarz & Ottesen, LLP; Harry K. Ahn

(57) ABSTRACT

A clamp for clamping an electrical terminal terminating an electrical wire to an electrically conductive post includes a saddle and a fastener. The saddle has an inner surface and at least partially circumferentially surrounds the post. A projection on the inner surface of the saddle is received in a hole of the electrical terminal. The fastener fastens the saddle to the post with the projection received in the electrical terminal so as to sandwich the electrical terminal between the post and the saddle.

20 Claims, 6 Drawing Sheets

CLAMP HAVING A SADDLE WITH A PROJECTION RECEIVED IN A HOLE IN A TERMINAL SANDWICHED BETWEEN THE SADDLE AND A CONDUCTIVE POST

TECHNICAL FIELD

The present invention relates to mechanical clamps, and in particular mechanical clamps for clamping an electrical terminal terminating an electrical wire to an electrically conductive post in the electric power industry.

BACKGROUND OF THE INVENTION

In the electric power industry, a fence surrounding an electrical substation is connected to an underground grounding system. As a requirement, a fence gate also needs to be connected to the grounding system. To do so, mechanical clamps can be used to electrically couple a fence section to the fence gate. For example, one terminal of a flexible braid assembly is clamped to the post of the fence section and the other terminal of the assembly is clamped to the post of the fence gate, thereby providing a solid electrical path from the fence gate to the underground grounding system through the braid assembly. The flexible nature of the braid assembly allows the fence gate to move or rotate relative to the fence section without breaking the electrical coupling between the gate and fence section.

Currently, standard ground rod clamps or their variation are used to clamp the flexible braid and the like to cylindrical or other posts to sandwich the braid terminal between the post and the clamp. While the standard clamps do provide the necessary electrical bonding, the mechanical rigidity can vary greatly from one installation to another. Moreover, use of the standard clamps do not provide a way for the installers to maximize the mechanical rigidity of the connection or to consistently assemble them together in an easily repeatable manner.

Therefore, it would be desirable to provide a clamping device and method for clamping an electrical terminal to an electrically conductive post which provide high mechanical rigidity in an easily repeatable manner.

BRIEF DESCRIPTION OF THE DISCLOSURE

A clamp for clamping an electrical terminal terminating an electrical wire to an electrically conductive post includes a saddle and a fastener. The saddle has an inner surface and at least partially circumferentially surrounds the post. A projection on the inner surface of the saddle is received in a hole of the electrical terminal. The fastener fastens the saddle to the post with the projection received in the electrical terminal so as to sandwich the electrical terminal between the post and the saddle.

Preferably, the projection is integrally formed as part of the saddle.

The clamp allows the electrical terminal to be clamped to the electrically conductive post with a high mechanical rigidity in an easily repeatable and consistent manner.

DETAILED DESCRIPTION OF THE INVENTION

Briefly, the present invention provides a much improved method for permanently affixing flexible braids, shunts or lugs to cylindrical or other shaped electrically conductive posts. The improved clamp includes a projection on a saddle which is sized to be received in a hole of an electrical terminal that terminates an electrical wire or cable.

The projection in the clamp provides a centering feature that allows an installer to consistently locate the hole of the electrical terminal during assembly. The projection also creates a direct interface with the hole of the electrical terminal to create an interference fit. The centering feature of the projection and the direct interface with the electrical terminal vastly improve the mechanical rigidity and the pullout force of the assembly. Moreover, the projection in the clamp provides a centering feature that allows an installer to very quickly and consistently locate the hole of the electrical terminal during assembly in an easily repeatable manner.

Figure 1:
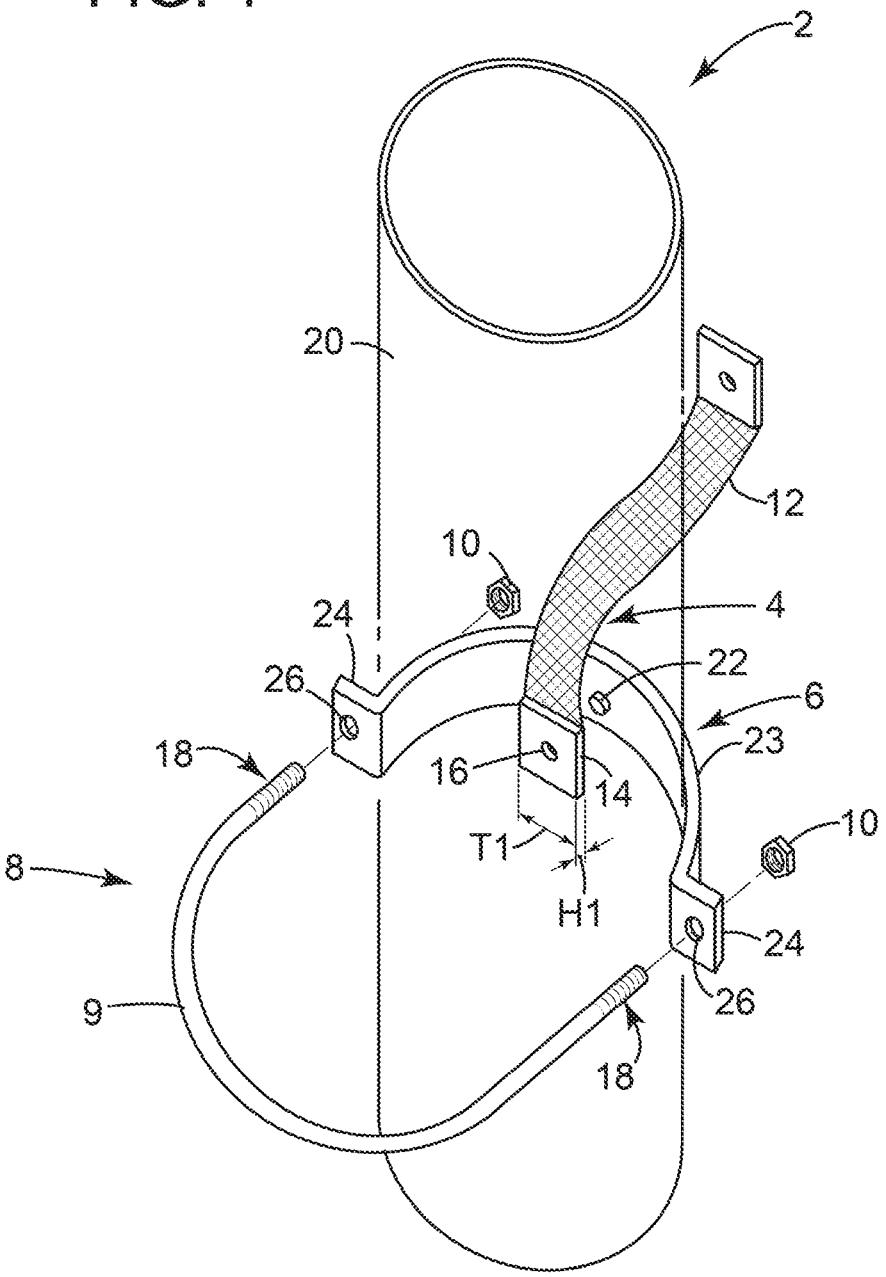
FIG. 1 is a perspective view of a clamp and braid assembly which is about to be affixed to an electrically conductive post according to one aspect of the present invention.

FIG. 1 is a perspective view of a clamp 2 and braid assembly 4 which is about to be affixed to an electrically conductive post 20 according to one aspect of the present invention.

As shown in FIG. 1, the braid assembly 4 includes an electrically conductive braid 12 made of woven copper wire which terminates at an electrical terminal 14 having a through-hole 16 and a width of T1 and thickness of H1. As shown, the terminal 14 is a cylindrical ferrule that has been pressed into a flat terminal to retain and couple to the braid 12. The length of the braid assembly 4 including the terminals 14 on both ends is typically between 6 inches and 24 inches depending on a particular application.

Figure 4:
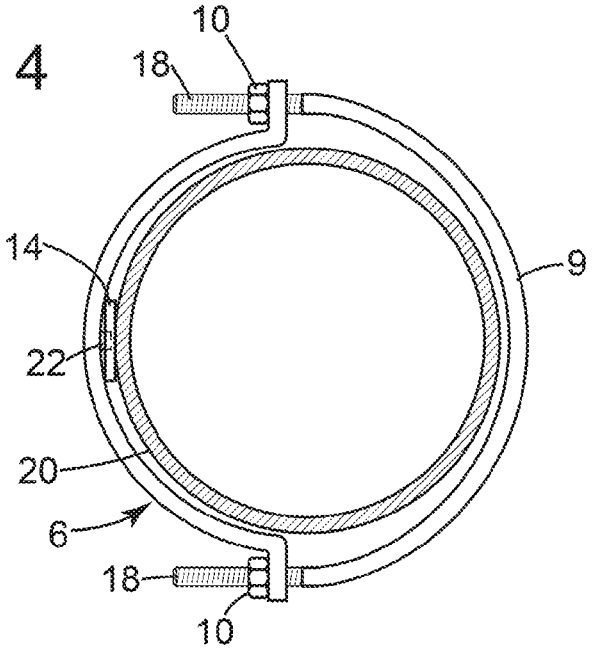
FIG. 4 is a side view of an assembled clamp of FIG. 1.

The clamp 2 includes a saddle 6 and a fastener 8 that fastens the braid assembly 4 between an electrically conductive post 20 and the saddle, essentially sandwiching the braid assembly 4 (see FIG. 4, for example). The post 20 can be a part of a fence gate for entering an electrical substation, for example.

The saddle 6 has a curved portion 23 (e.g., C-shaped portion as shown) whose concave side 7 faces the post 20, two flat ends 24 extending from the curved portion with each end having a through-hole 26, and a projection 22 on an inner surface (concave side) of the curved portion at its midpoint such that the projection is centered both laterally and longitudinally within the curved portion 23 of the saddle 6. The fastener 8 includes two nuts 10 and a U-bolt 9 having two threaded ends 18.

To clamp the braid terminal 14 to the post 20, the terminal is held against the saddle 6 so that the through-hole 16 faces the projection 22. The projection 22 is sized to be received in the terminal through-hole 16. The projection 22 is then inserted into the through-hole 16 to couple the saddle 6 and terminal 14 together. While the coupled saddle 6 and terminal 14 are pressed against the post 20, the U-bolt 9 is inserted through the through-holes 26 of the saddle to surround the post. The nuts 10 are then threaded into the respective threaded ends 18 to securely affix the braid assembly terminal 14 to the post 20. As more clearly shown in FIG. 4, the braid terminal 14 is securely affixed to the post 24 by the compressive force applied by the saddle 6 and fastener 8.

The saddle 6 and fastener 8 can be made of non-conductive materials so long as the mechanical properties allow the material to withstand the mechanical forces apportioned to it during installation, use, or some type of an electrical event. However, the non-conductive material can be damaged by heat during a potential electrical event. Accordingly, the preferred material of the saddle 6 as well as the fastener 8 are conductive materials such as Copper, Copper alloys, Silicon Bronze alloys, Aluminum, Aluminum alloys, steel and steel alloys and the like.

Figure 2A:
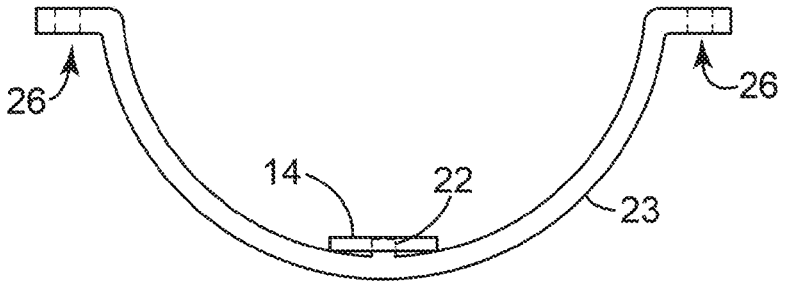
FIG. 2A is a side view of a saddle of FIG. 1.
Figure 3A:
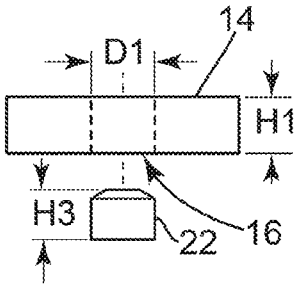
FIG. 3A is a side view of a projection of the clamp of FIG. 1.

As shown in FIG. 3A, when the projection 22 is inserted into the terminal through-hole 16, the depth H3 of the projection is such that the top of the projection sits either flush with the outside surface of the terminal 14 or within the through-hole so as to not interfere with the direct electrical connection between the terminal 14 and the post 20 (see FIG. 2A also). The top portion of the projection 22 has a slight inward angle such as 20 degrees from the sidewall (beveled edge) to assist the installer to more easily locate the through-hole 16.

Preferably, the projection 22 is integrally formed with the saddle 6 as a single integrated piece. For example, molten metal can be poured into a sand mold in a sand casting process to form a single integrated piece with the projection 22 as part of the saddle 6.

FIG. 2A is a side view of a saddle of FIG. 1 with the terminal 14 whose through-hole 16 has received the projection 22. As shown, the projection 22 is centered longitudinally and laterally within the inner surface of the saddle 23. As such, an imaginary line drawn longitudinally through the center of the through-holes 26 cross the center of the projection 22 and an imaginary line drawn laterally through the center of the projection divides the saddle 6 in half. The top of the projection 22 sits below the top surface of the terminal 14 so as not to interfere with the terminal making solid contact with the post 20.

As can be appreciated, the projection 22 provides a centering feature that consistently locates the braid terminal 14 or any other terminal having a hole therein relative to the saddle 6. This novel feature provides several advantages. One, once the braid terminal 14 is coupled to the post 20, the projection 22 which is inserted into the terminal provides resistance to movement of the terminal, which provides a substantial improvement in mechanical pullout force. This is very important in a grounding application where the electrical connection is exposed to the elements. The substantially improved mechanical pullout force improves the overall performance of the electrical connection whose integrity would be repeatedly tested during its life due either to electrical or mechanical disturbances.

Two, because the projection 22 always locates the braid terminal 14 at the center of the saddle 6, it provides a consistent installation of the electrical connection without having to be concerned about the terminal position relative to the clamp 6.

Three, because the automatic centering function of the projection 22 eliminates the need to manually check the terminal position relative to the clamp 6, the present invention substantially improves the installation time.

Figure 2B:
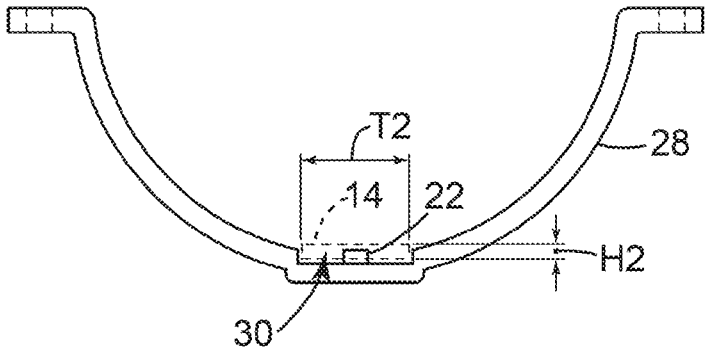
FIG. 2B is a side view of an alternative embodiment of the saddle of FIG. 1.
Figure 5:
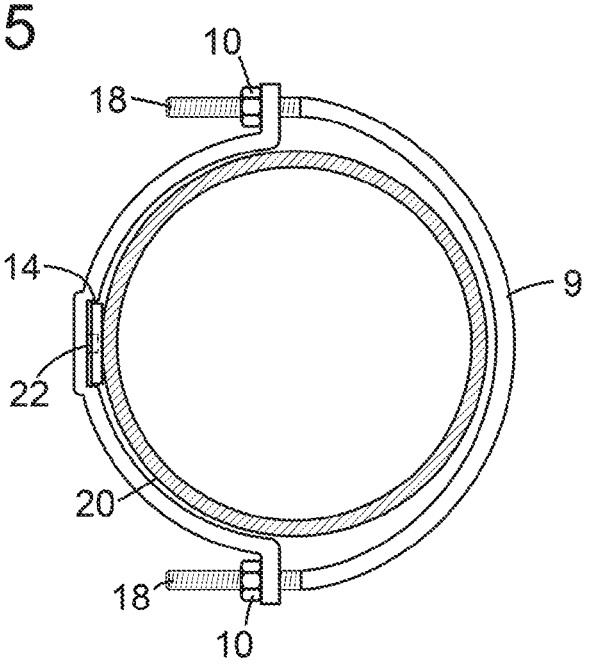
FIG. 5 is a side view of an assembled clamp according to an alternative embodiment of the present invention.

FIG. 2B is a side view of an alternative embodiment of the saddle of FIG. 1 while FIG. 5 illustrates a side view of the clamp 2 which is clamped to the post 20. As shown, a saddle 28 includes a recess such as a wide rectangular groove 30 which is shaped to receive the terminal 14. The width T2 of the groove is slightly wider than T1 and the depth H2 of the groove is the same or slightly less than the depth H1 of the terminal 14. If the saddle 6 is not as electrically conductive as the terminal 14, then the depth H2 should not be larger than H1 so as to prevent a poor electrical contact between the post 20 and the terminal. In some applications, the groove 30 may provide an improved electrical contact between the terminal 14 and post 20 as well as a further increase in mechanical pullout force from the sidewalls of the groove.

Figure 3B:
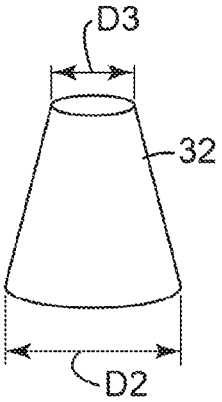
FIG. 3B is a perspective side view of a projection according to an alternative embodiment of the present invention.

FIG. 3B is a perspective side view of a projection 32 according to an alternative embodiment of the present invention.

As shown in FIG. 3B, the projection 32 has a frusto-conical shape whose base has a diameter of D2 and whose top has a diameter of D3. In one embodiment, diameter D1 of the through-hole 16 is larger than diameter D3 and smaller than diameter D3 such that the compressive force of the saddle 6 is concentrated around the circumferential side wall which presses against the through-hole 16, rather than the side edges of the terminal 14. In some applications, the projection 32 of FIG. 3B may maintain a solid electrical connection between the terminal 14 and the post 20 over a longer time than the projection 22 where the terminal may bend over time from the compressive force exerted against the side edges of the terminal 14.

Figure 3C:
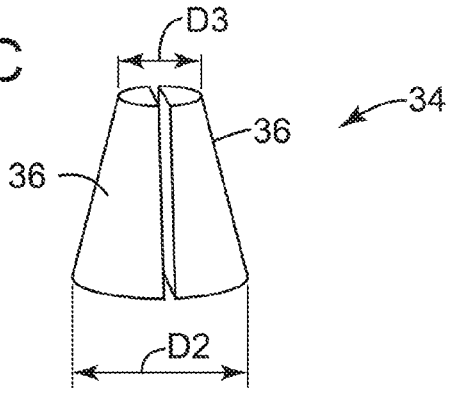
FIG. 3C is a perspective side view of a projection according to another alternative embodiment of the present invention.

FIG. 3C is a perspective side view of a projection 34 according to another alternative embodiment of the present invention. Similar to the projection 32 of FIG. 3B, FIG. 3C shows another projection 34 which has a general frusto-conical shape. The projection 34 includes two identical spaced apart projecting members 36 that face each other. In one embodiment, diameter D1 of the through-hole 16 is larger than diameter D3 and smaller than diameter D3 such that the compressive force of the saddle 6 is concentrated around the circumferential side wall and the through-hole 16, rather than the side edges of the terminal 14. In one embodiment, each projecting member 36 provides a biasing force against the terminal 14 to provide a more solid electrical contact between the terminal and the post 20.

Figure 3D:
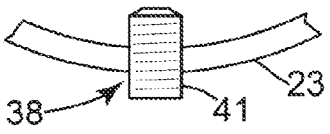
FIG. 3D is a side view of a projection according to another alternative embodiment of the present invention.

FIG. 3D is a side view of a projection 41 according to another alternative embodiment of the present invention.

As shown in FIG. 3D, the saddle 6 can have a threaded through-hole 38 and the projection can be a screw such as a set screw 41 which is threaded into the through-hole such that its tip is positioned at a selected height above the inner surface 7 of the saddle 6.

Figure 6:
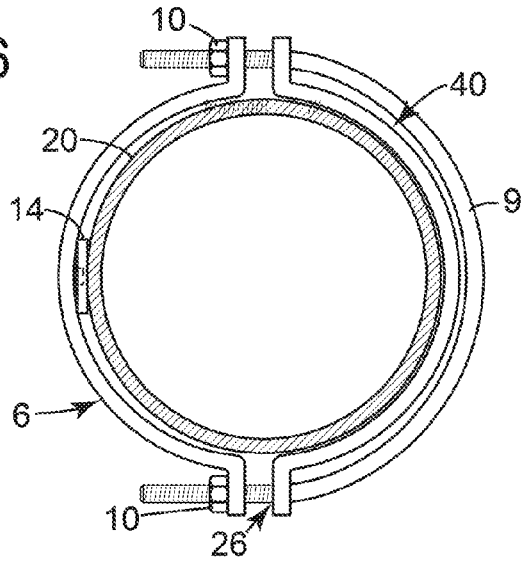
FIG. 6 is a side view of an assembled clamp according to another alternative embodiment of the present invention.

FIG. 6 is a side view of a clamp according to another alternative embodiment of the present invention.

The clamp as shown in FIG. 6 includes a second saddle 40 which is identical to the first saddle 6, but it lacks the projection 22. The U-bolt is inserted through the through-holes 26 of both saddles 6, 40 and tightened with the nuts 10 to securely attach the terminal 14 to the post 20.

Figure 7:
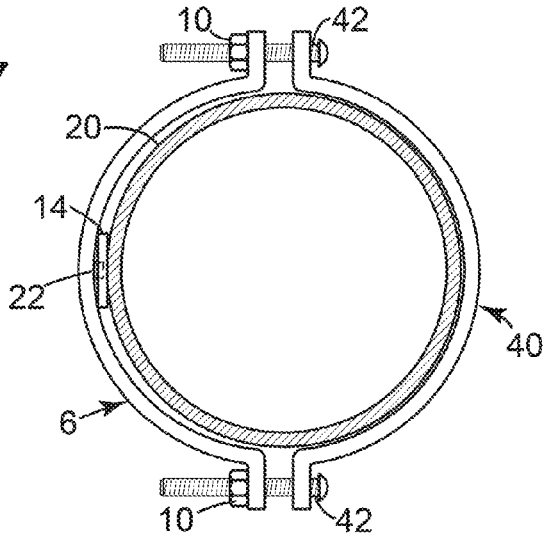
FIG. 7 is a side view of an assembled clamp according to another alternative embodiment of the present invention.

FIG. 7 is a side view of an assembled clamp according to another alternative embodiment of the present invention.

The clamp as shown in FIG. 6 is similar to that of FIG. 6, except that the U-bolt 9 is replaced with a pair of regular bolts 42, which are then inserted through the through-holes 26 of both saddles 6, 40 and tightened with the nuts 10 to securely attach the terminal 14 to the post 20.

Figure 8:
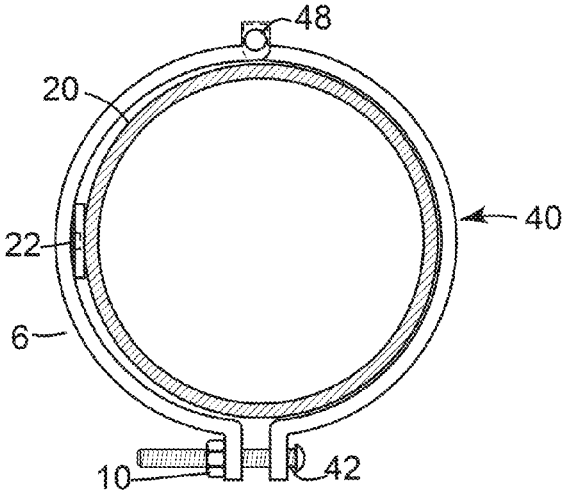
FIG. 8 is a side view of an assembled clamp according to another alternative embodiment of the present invention.

FIG. 8 is a side view of an assembled clamp according to another alternative embodiment of the present invention.

The clamp as shown in FIG. 8 includes the first saddle 6 and a second saddle 40 which lacks the projection 22 of the first saddle. The two saddles 6,40 are pivotally joined by a pin 48 such as a rivet. Once the through-hole 16 of the terminal 14 receives the projection 22, the saddles 6, 40 are mounted to the post 20 with the bolt 42 and nut 10.

Figure 9:
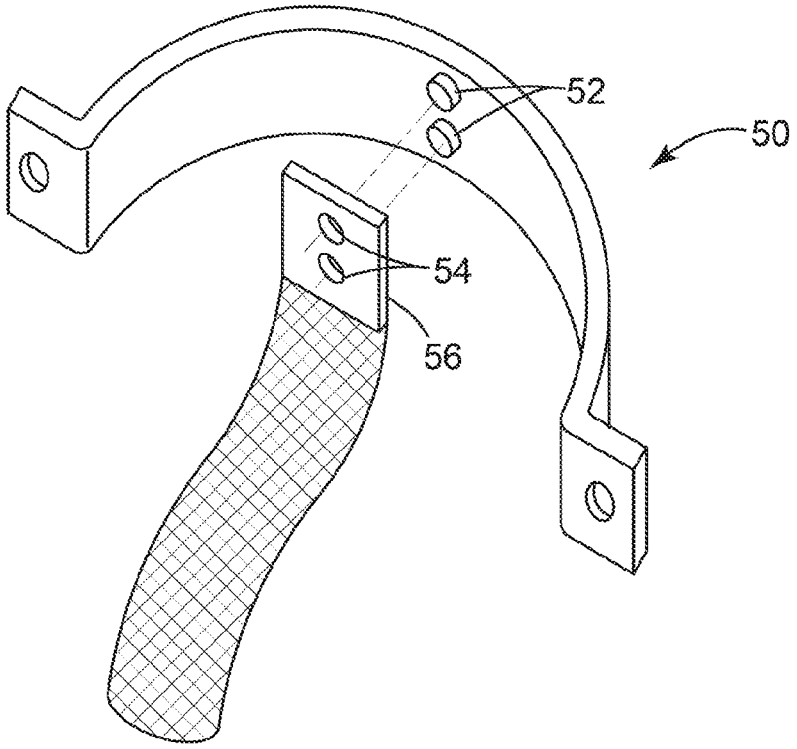
FIG. 9 is an alternate embodiment of a saddle of the present invention.

FIG. 9 is an alternate embodiment of a saddle of the present invention. To accommodate some terminals that have two or more through-holes 54, a saddle 50 can be equipped with multiple projections 52. As shown in FIG. 9, the saddle 50 has two projections 52 that are uniformly spaced to be inserted through the respective through-holes 54 of a terminal 56 that terminates an electrical wire.

It is important to note that while the present invention has been illustrated with a flexible braid assembly, it can accommodate any type of a terminal that contains at least one hole such as lugs, shunts, and the like.

The foregoing specific embodiments represent just some of the ways of practicing the present invention. Many other embodiments are possible within the spirit of the invention. Accordingly, the scope of the invention is not limited to the foregoing specification, but instead is given by the appended claims along with their full range of equivalents.

What is claimed is:

1. A clamp for clamping an electrical terminal terminating an electrical wire to an electrically conductive post, comprising:

a saddle having an inner surface and adapted to at least partially circumferentially surround the post, the saddle having a projection positioned on the inner surface and adapted to be received in a hole of the electrical terminal; and a fastener adapted to fasten the saddle to the post with the saddle projection being received in the electrical terminal so as to sandwich the electrical terminal between the post and the saddle.

2. The clamp according to claim 1, wherein the projection includes a frusto-conical portion.

3. The clamp according to claim 1, wherein the projection includes at least two projecting members facing each other.

4. The saddle according to claim 1, wherein the projection includes at least two projecting members facing each other and has a frusto-conical shape.

5. The clamp according to claim 1, wherein the saddle including the projection is a single integrally formed piece.

6. The clamp according to claim 1, wherein the saddle includes a threaded through-hole and the projection includes a screw threaded into the through-hole.

7. The clamp according to claim 1, where the saddle includes a C-shaped main portion and the projection is positioned at a midpoint thereof.

8. The clamp according to claim 1, wherein the saddle includes a first end having a hole and a second end having a hole.

9. The clamp according to claim 8, wherein the fastener includes a U-bolt having first and second ends that are inserted through the holes of the first and second ends of the saddle for clamping the saddle to the electrically conductive post.

10. The clamp according to claim 1, wherein the saddle is a first saddle, further comprising a second saddle pivotally coupled to the first saddle.

11. The claim according to claim 1, wherein the saddle includes a groove for receiving the terminal and the projection is positioned on the groove.

12. A clamp for clamping an electrical terminal attached to an electrical wire to an electrically conductive post, comprising:

a C-shaped saddle having an inner surface and shaped to at least partially circumferentially surround the electrically conductive post, the C-shaped saddle including an integrally formed projection positioned at a midpoint of the inner surface and sized to be received in a hole of the electrical terminal; and a fastener adapted to fasten the saddle to the post with the saddle projection being received in the electrical terminal so as to sandwich the electrical terminal between the post and the saddle.

13. The clamp according to claim 12, wherein the projection includes a frusto-conical portion.

14. The clamp according to claim 13, wherein the projection includes at least two projecting members facing each other.

15. The clamp according to claim 12, wherein the saddle includes a threaded through-hole and the projection includes a screw threaded into the through-hole.

16. The clamp according to claim 12, wherein:

the saddle includes a first end having a hole and a second end having a hole; and the fastener includes a U-bolt having first and second ends that are inserted through the holes of the first and second ends of the saddle for clamping the saddle to the electrically conductive post.

17. The clamp according to claim 12, wherein the saddle is a first saddle, further comprising a second saddle pivotally coupled to the first saddle.

18. The claim according to claim 12, wherein the saddle includes a groove for receiving the terminal and the projection is positioned on the groove.

19. The clamp according to claim 12, further comprising the electrical terminal terminating the electrical wire, wherein:

the terminal has an upper surface and a lower surface;

the projection extends from the inner surface of the C-shaped saddle and terminates at a distal end;

the distal end of the projection lies above the lower surface and at or below the upper surface of the terminal when the projection is inserted through the electrical terminal hole.

20. A method of clamping an electrical terminal terminating an electrical wire to an electrically conductive post, comprising:

inserting into a hole of the electrical terminal a projection extending from an inner surface of a saddle adapted to at least partially circumferentially surround the post;

fastening to the electrically conductive post the saddle whose projection is inserted into the electrical terminal hole so as to sandwich the electrical terminal between the post and the saddle.

* * * * *